United States Patent [19]

Venderbosch

[11] Patent Number: 5,003,232

[45] Date of Patent: Mar. 26, 1991

[54] LUMINAIRE HAVING DETACHABLE REVERSIBLE HOLDERS FOR SUPPORTING DIFFERENT NUMBERS OF TUBULAR LAMPS

[75] Inventor: Josephus W. Venderbosch, Winterswijk, Netherlands

[73] Assignee: U.S. Philips Corporation, New York, N.Y.

[21] Appl. No.: 870,274

[22] Filed: Jun. 3, 1986

[30] Foreign Application Priority Data

Jun. 12, 1985 [NL] Netherlands ..... 8501686

[51] Int. Cl.[5] ..... H05B 41/00

[52] U.S. Cl. ..... 315/312; 315/324; 439/235

[58] Field of Search ..... 315/312, 324; 339/57, 339/50 R, 52 R, 54, 55; 439/235

[56] References Cited

U.S. PATENT DOCUMENTS 2,501,485 3/1950 Tuck ..... 315/320

FOREIGN PATENT DOCUMENTS 263142 7/1968 Austria ..... 339/57
E 7278 5/1956 Fed. Rep. of Germany ..... 339/50
8126463 5/1982 Fed. Rep. of Germany .
440453 7/1967 Switzerland ..... 339/52 R

*Primary Examiner*—Eugene R. LaRoche
*Attorney, Agent, or Firm*—Brian J. Wieghaus

[57] ABSTRACT

A luminaire for elongated tubular lamps comprising an elongated supporting member 1 and a plurality of lamp holders 3*a*, 3*b*. Lamp holders 3*a*, 3*b* are arranged at opposing ends of supporting member 1. Each lamp holder has two sides, one side having n lamp fittings and the other side having n+m lamp fittings. Each of the lamp holders 3*a*, 3*b* is detachably secured on supporting member 1, and is reversibly adaptable for providing a luminaire with either a large or small number of tubular lamps.

10 Claims, 2 Drawing Sheets

LUMINAIRE HAVING DETACHABLE REVERSIBLE HOLDERS FOR SUPPORTING DIFFERENT NUMBERS OF TUBULAR LAMPS

BACKGROUND OF THE INVENTION

The invention relates to a luminaire for tubular discharge lamps comprising an elongate support, to the ends of which holders suitable for one or more lamps can be optionally secured. Such a luminaire is known from German Gebrauchsmuster No. 8126463.

The known luminaire is more particularly suitable for elongate tubular luminescent low-pressure mercury vapour discharge lamps, in which the plate-shaped metal support forms part of a housing which partly surrounds the lamps. At each end of the support are formed two recesses, in each of which a holder with a lamp fitting can be secured. The luminaire is then suitable for two lamps. When in each pair of recesses a specifically formed holder provided with only one lamp fitting is secured at the ends, a one-lamp construction of the luminaire is obtained. Such a construction is especially advantageous for the manufacturer because during the manufacture only one type of support is used both in the one-lamp construction and in the two-lamp construction. The holders are locked in the support and can be detached therefrom only with great difficulty so that a user cannot easily choose himself the construction he wants. A disadvantage of the known luminaire moreover is that a comparatively large number of separate holders is necessary.

SUMMARY OF THE INVENTION

The invention has for its object to provide a luminaire, in which a user can determine in a simple manner the construction for a large or small number of lamps.

According to the invention, this object is achieved in a luminaire of the kind mentioned in the opening paragraph in that each holder is reversible and has two sides separate from one another, the first side being provided with n lamp fittings and the second side being provided with n+m lamp fittings (n,m=1,2,3 . . . etc.), while the holders can be detached from the support.

The luminaire according to the invention has only two holders, which can be detached from the support by a user. By reversing the holders, the luminaire can be used optionally for the large number or the small number of lamps. The use of specifically formed additional holders is avoided.

The holders preferably comprise a plate-shaped part, whose one side is provided with a single lamp fitting and whose other side is provided with two lamp fittings.

The holders, which preferably consist of synthetic material, are then compact and can be manufactured in a comparatively simple manner. Furthermore, in the housing of the luminaire, of which the support forms part, means for only a small number of auxiliary components for operating the lamp (such as electrical stabilization ballasts, starters etc.) are required.

In a preferred embodiment of the luminaire, the holders cooperate with contact members which are secured on the support and which accommodate conductors for supplying power to the lamp fittings.

The contact members, which preferably also consist of synthetic material, include metal conductors, an electrical connection being established with metal connection pins projecting from a holder when the holder is placed in the contact member.

The holders are preferably secured mechanically on the support by means of resilient lugs. Substantially no force is then exerted on the electrical connection, as a result of which the risk of damage of the connection pins is reduced. In an embodiment, the contact members are provided with resilient lugs, which are provided with specifically formed cams and cooperate with recesses in the holder. Such lugs can be actuated in a simple manner by a user in order to detach the holder from the support.

BRIEF DESCRIPTION OF THE DRAWING

An embodiment of a luminaire according to the invention will be described more fully with reference to the drawings.

In the drawings.

DESCRIPTION OF THE PREFERRED EMBODIMENT

Figure 1:
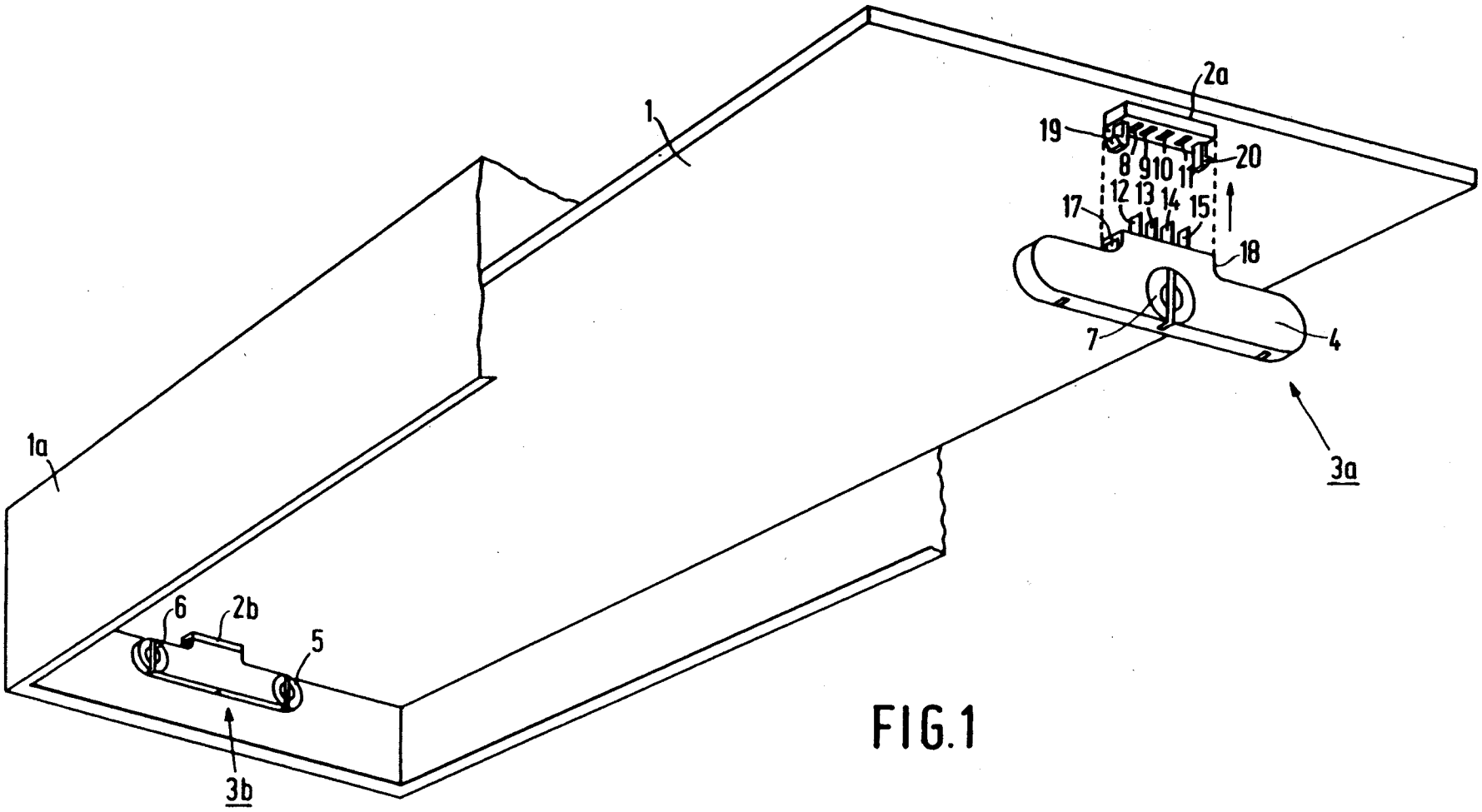
FIG. 1 shows diagrammatically in elevation a luminaire according to the invention.

The luminaire shown in FIG. 1 is suitable for elongate tubular low-pressure mercury vapour discharge lamps. The luminaire comprises a metal support 1, which forms part of a housing 1*a* (shown partially). The ends of the support are provided with contact members (2*a*, 2*b*) of synthetic material, in which holders (such as 3*a*, 3*b*) can be placed. The holders and the contact members are symmetrical to a plane at right angles to the support. Each holder comprises a plate-shaped part 4, one side of which is provided with two fittings 5 and 6 and the other side of which is provided with a single fitting 7. When the holders (3*a*, 3*b*) are placed in the contact members (2*a*, 2*b*), as shown in FIG. 1, a luminaire is obtained which is suitable for two tubular low-pressure mercury vapour discharge lamps ("TL" lamps). When the holders are removed from the contact member and are reversed, the luminaire is suitable for only one lamp.

Each contact member (such as 2*a*) is provided with four openings 8 to 11 for the metal pins 12 to 15 of a holder (such as 3*a*). These pins establish a contact with metal sleeves arranged in the contact member so that an electrical connection is formed between the lamp ends inserted into the fittings (5, 6, 7) and electric circuit wiring (not shown in the drawing), which is located on the other side of the support and is connected to the contact member.

The holder is mechanically secured to the support by means separate from the electrical connection. For this purpose, the holder is provided with two recesses 17 and 18, which can accommodate cams on respective resilient lugs 19 and 20 of synthetic material present on the contact member. With the cams located in the recesses 17 and 18 the holder is locked on the contact member.

By means of the electric circuit wiring, the contact member 2 is connected to the supply voltage and to the auxiliary components (such as an electrical stabilization ballast and a starter) for operating the lamp(s).

In an embodiment of the luminaire, these auxiliary components are fixedly secured on the support or in the housing. In an alternative embodiment, the said components can be detached from the support. Depending upon the user's choice, for example, two ballasts and two starters are then placed on the support.

Figure 2:
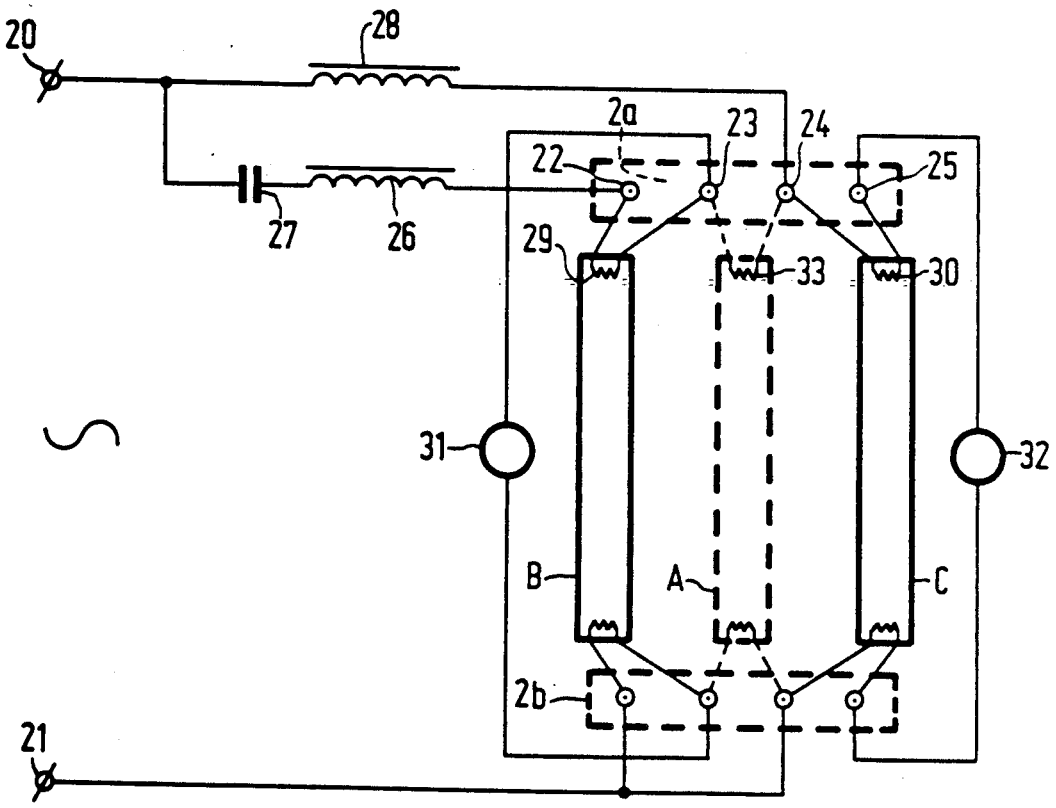
FIG. 2 shows an electric circuit diagram for operating the lamps in the aforementioned luminaire.

FIG. 2 shows a diagram of an electric circuit for a one-lamp situation (dotted lamp A) and a two-lamp situation (lamps B and C). In the circuit, reference numerals 20 and 21 denote input terminals intended to be connected to an alternating voltage of about 220 V, 50 Hz or 110 V, 60 Hz. In the circuit diagram, the contact members (*2a, 2b*) are indicated by dotted lines. Furthermore, the electrical members (such as metal sleeves) present therein are indicated at the member *2a* by points, such as 22, 23, 24 and 25. A series arrangement of a first ballast 26 and a capacitor 27 is present between 22 and 20. A ballast 28 is present between 20 and 24. In a two-lamp construction, an electrode (29) of the lamp B is present between 22 and 23 and an electrode 30 of the lamp C is present between 24 and 25. The starters 31 and 32 are then also operative. When one lamp (such as lamp A) is placed, the starter 32, the ballast 26 and the capacitor 27 are inoperative, as appears from the circuit diagram. The electrode 33 of the lamp A is then in fact connected between 23 and 24. In an alternative embodiment, the wiring is connected to an electric high-frequency oscillator circuit for feeding the lamp(s). Such a circuit is described, for example, in the Netherlands Patent Application Ser. No. 8201631 laid open to public inspection to which U.S. Pat. No. 4,525,648 corresponds.

What is claimed is:

1. A luminaire for tubular lamps, comprising:

an elongated supporting member;

a plurality of lamp holders each arranged on said supporting member, each lamp holder having a first side and a second side, said first side having a first natural number n lamp fittings, said second side having a second natural number n+m lamp fittings; and means for detachably securing each of said lamp holders on said supporting member, and for making electrical contact with the respective lamp holder; each lamp holder being reversibly securable on the support so that either the n fitting sides or the n+m fitting sides are facing each other;

whereby for a luminaire to be fitted with n tubular lamps, each of said lamp holders is secured on said supporting members with the first sides facing each other, and for a luminaire to be fitted with n+m tubular lamps, each of said lamp holders is reversed on said supporting member so that each of said second sides face each other.

2. A luminaire as claimed in claim 1 wherein each of said lamp holders comprises a plate-shaped part, each of said first sides having a single lamp fitting and each of said second sides having a pair of lamp fittings.

3. A luminaire as claimed in claim 2, wherein said means for making electrical contact includes a pair of contact members arranged on said supporting member; and each of said lamp holders has electrical connection means having electrical conductors, each of said conductors being accommodated in and cooperating with a respective one of said contact members making electrical contact therewith.

4. A luminaire as claimed in claim 1, wherein said means for making electrical contact includes a pair of contact members arranged on said supporting member; and each of said lamp holders has electrical connection means having electrical conductors, each of said conductors being accommodated in and cooperating with a respective one of said contact members making electrical contact therewith.

5. A luminaire as claimed in claim 4, wherein each of said lamp holders has at least one recess, and each of said contact members has at least one resilient lug, each recess cooperating with a respective lug for locking each of said lamp holders in a detachable manner to each of said contact members.

6. A luminaire for tubular lamps, comprising:

a pair of lamp holders each having a first side having a first natural number M of lamp sockets and a second side having a second different natural number M+N of lamp sockets;

a support having a pair of receptacles for receiving said lamp holders with said first sides facing each other or with said second sides facing each other and spaced so that tubular lamps may be supported between said lamp holders;

means for detachably securing each said lamp holder in a respective receptacle in a reversible manner;

first means comprising a ballast for controlling lamp operating current for M lamps;

second means comprising a ballast for controlling lamp operating current for M+N lamps; and means for connecting said first means to said M sockets when said lamp holders are secured on said support with said M sides facing each other and for connecting said second means to said M+N sockets when said lamp holders are secured to said support with said M+N sides facing each other;

whereby for a said luminaire to be fitted with M lamps, each of said holders is secured to a respective receptacle with said first sides facing each other and for a said luminaire to be fitted with M+N lamps each of said holders is secured to a respective receptacle with said second sides facing each other.

7. A luminaire as claimed in claim 6, wherein said connecting means comprises each holder having a first plurality of contacts connected to said M sockets and a second plurality of contacts connected to said N sockets, and each receptacle having a first plurality of contacts connected to said first means and a second plurality of contacts connected to said second means, each first receptacle contact contacting a corresponding first holder contact when said holders are secured in said receptacles with said first sides facing each other so that each of said M sockets is connected to said first means, and each second receptacle contact contacting a corresponding second holder contact when said holders are secured in said receptacles with said second sides facing each other so that each of said N sockets is connected to said second means.

8. A luminaire as claimed in claim 7, wherein said means for detachably securing comprises each lamp holder having a recess, and each receptacle having a resilient lug, each recess cooperating with a respective lug for locking each lamp holder in a detachable manner to a respective receptacle.

9. A luminaire as claimed in claim 6, wherein said first means further comprises means for starting said M lamps and said second means further comprises means for starting said N lamps.

10. A luminaire as claimed in claim 7, wherein said first means further comprises means for starting said M lamps and said second means further comprises means for starting said N lamps.

* * * * *